United States Patent [19]

Knox

[11] 4,074,453

[45] Feb. 21, 1978

[54] DEVICE FOR HOLDING FLEXIBLE, YIELDABLE INFORMATION CARRIERS

[76] Inventor: John E. Knox, Klosterhof 4, 7581 Eisental-Affental, Germany

[21] Appl. No.: 595,815

[22] Filed: July 14, 1975

[51] Int. Cl.[2] ..... B41J 11/64

[52] U.S. Cl. ..... 40/352; 40/354; 197/181.1

[58] Field of Search ..... 40/341–357, 40/10 B, 142 A; 35/7 A; 197/181.1, 181.2

[56] References Cited

U.S. PATENT DOCUMENTS

| | | | |
|---|---|---|---|
| 912,596 | 2/1909 | McCreary | 40/352 |
| 2,530,437 | 11/1950 | Marks | 40/352 X |
| 3,129,695 | 4/1964 | Adelman | 40/352 X |

*Primary Examiner*—Paul T. Sewell

*Attorney, Agent, or Firm*—Allison C. Collard

[57] ABSTRACT

A device for holding flexible, yieldable information carriers such as paper in a correct readable position comprising a retaining or clamping device for the flexible, yieldable information carrier for at least partially rigidizing the same so that it remains in a free supported reading position.

3 Claims, 18 Drawing Figures

(A-A)

DEVICE FOR HOLDING FLEXIBLE, YIELDABLE INFORMATION CARRIERS

The subject invention relates to a device for holding a flexible, yieldable, or soft unstable information carriers, such as paper in a correct position, without the assistance of the human hand.

The known devices of this type require either a platform on which the paper rests, or a complicated work locating fixture which supports the information carrier such as, for example, a paper. The known devices of this type support the flexible, yieldable, soft characteristic of the information carrier, and to hold it in the correct position for reading. However, these known devices have the disadvantage that they are either structurally too cumbersome, and may require too many mechanical parts, or that they are too complicated and therefore too expensive. Furthermore, the known devices are also disadvantageous in that they are too large, so that they are cumbersome when mounted on a machine.

It is therefore an object of the present invention to provide a device of the aforementioned type which is not only substantially simpler in its structure, but which is also capable of holding a flexible, soft information carrier, such as a piece of paper in a readily readable position, without using too many structural means. In order to accomplish the above mentioned object of the invention, a device is provided for holding a flexible, yieldable, soft and unstable information carrier, such as paper in a readable position without the aid of a hand. The device provides a means which partially stiffens the information carrier by holding or clamping it, so that the carrier is self supporting, and in a readily readable position. While a normal typewriter page does not remain in a perpendicular position for reading on its own, such a page may be at least stiffened to a point by using the subject device so that it remains in a readable position.

In a preferred embodiment of the invention, the stiffening means of the subject invention may either be self-supporting, or connected with a table or a wall. The stiffening means may also be connected or combined with other devices such as, for example, typewriters, teletype, input equipment for data processing installations, etc.

In a specific embodiment of the invention, the device for stiffening the information carrier essentially consists of an angled or curved surface, for example, made of metal or plastic material so that the angle runs along an axis horizontally, or if desired, up to 75° from the vertical plane. The device cooperates with a clamping means, such as a clamp or a runner (roller), which gives the paper the required angle for stiffening, so that the information carrier may be maintained in a self supporting and correct readable position. The angled strip or the angled surface is adjustable in a horizontal or vertical position, or can assume any inclined angle for the information carrier. When the device is used, the information carrier, such as the paper can be placed against the angled strip or surface, and can be locally held in position, so that the information carrier becomes at least partially stiff. The means for retaining the information carrier to the angled surface may consist of different types. For example, it is possible to provide a clamp which presses the information carrier against the angled strip or surface.

Furthermore, an angled roller may be provided which is retained at a given position on the angled strip, or the angled surface by means of a magnet and thereby pushes the information carrier against the angled surface, thus stiffening the surface.

Other objects and features of the present invention will become apparent from the following detailed description when taken in connection with the accompanying drawings which disclose several embodiments of the invention. It is to be understood that the drawings are designed for the purposes of illustration only, and are not intended as a definition of the limits and scope of the invention disclosed.

In the drawings, wherein similar reference numerals denote similar elements throughout the several views.

Figure 9:
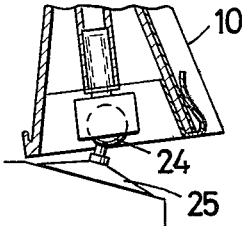
Figure 9A:
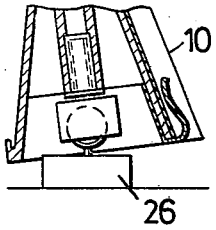
Figure 5:
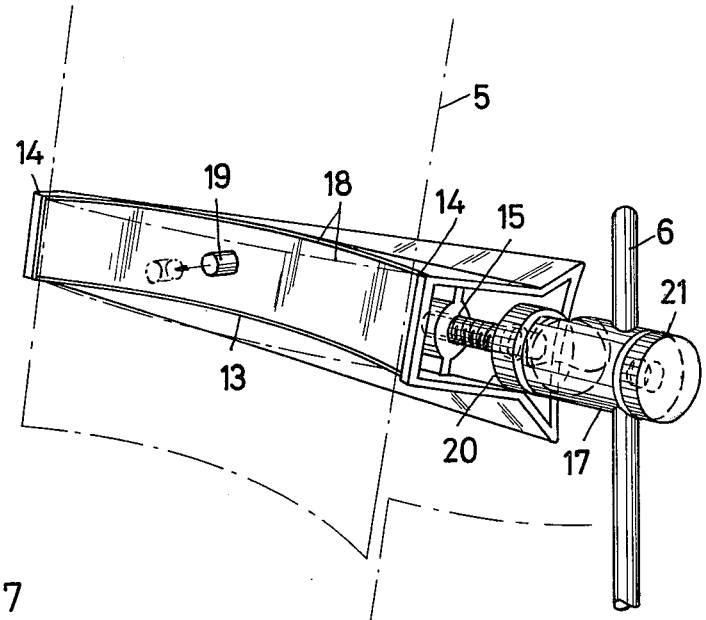
Figure 7:
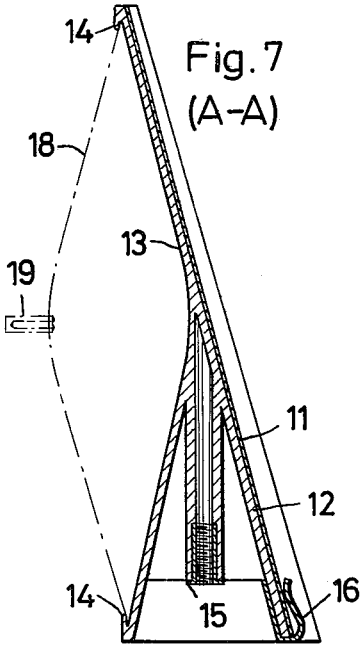
Figure 6:
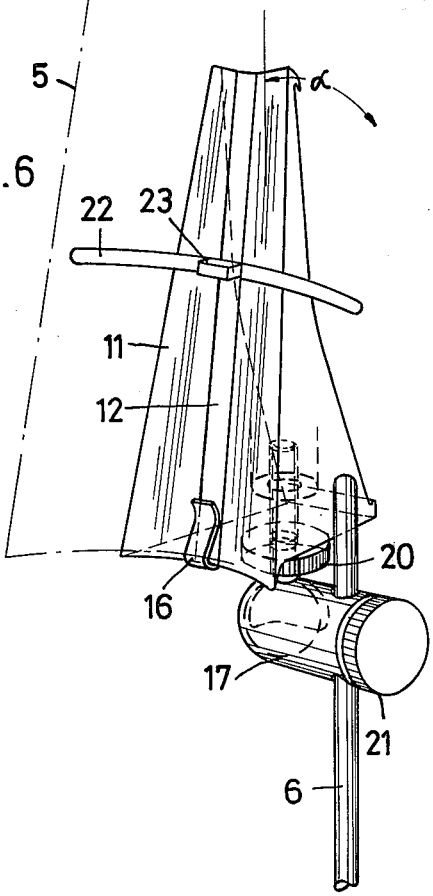
Figure 8:
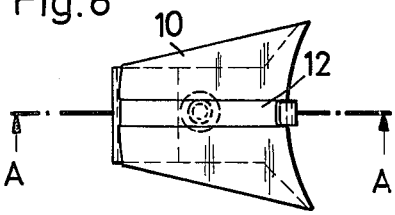
Figure 10:
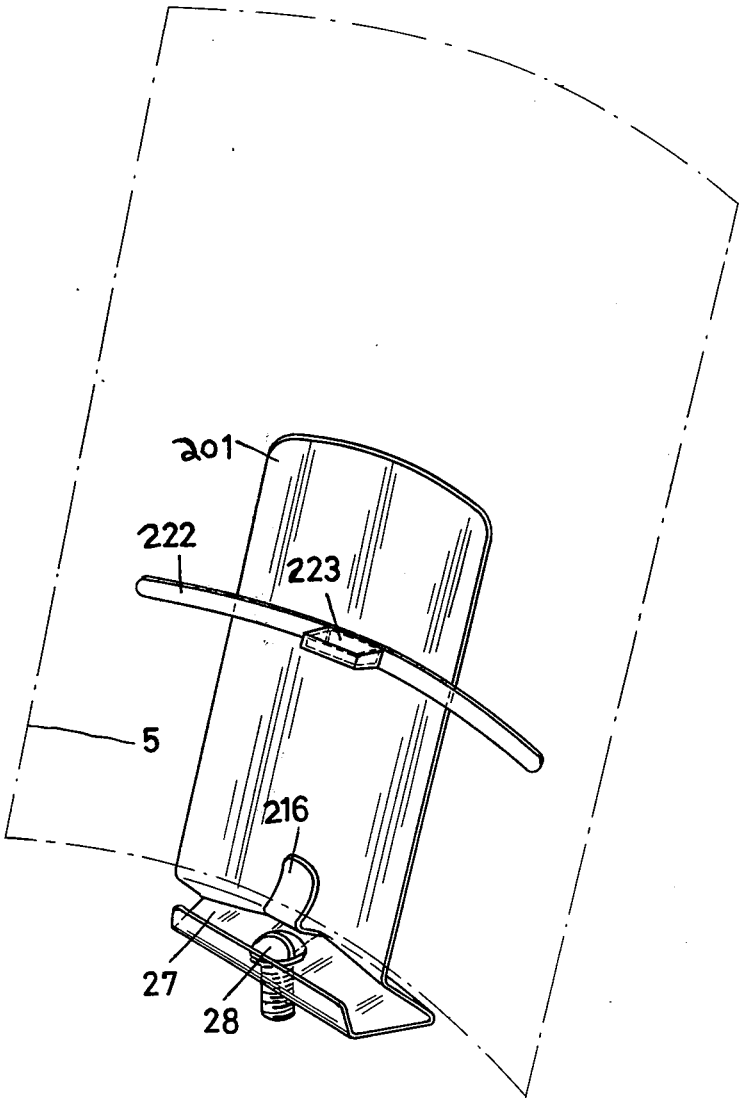
Figure 11:
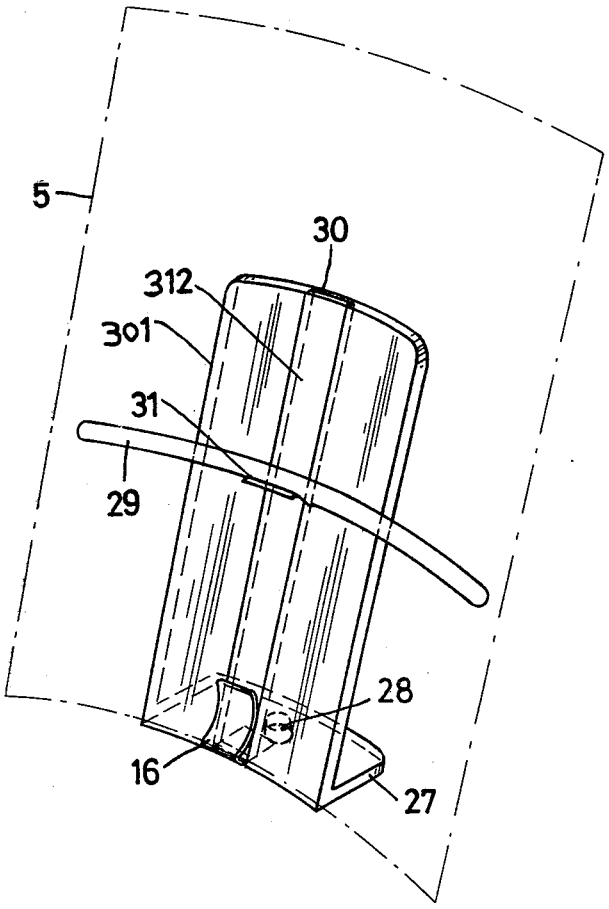
Figure 12:
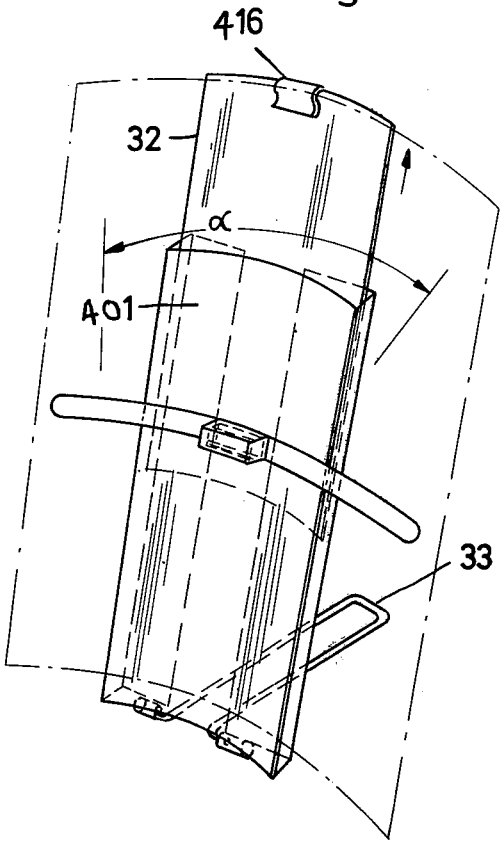
Figure 13:
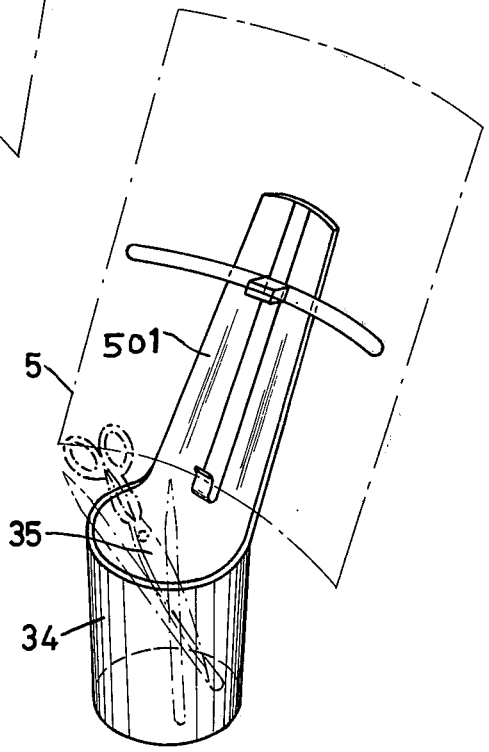
Figure 14:
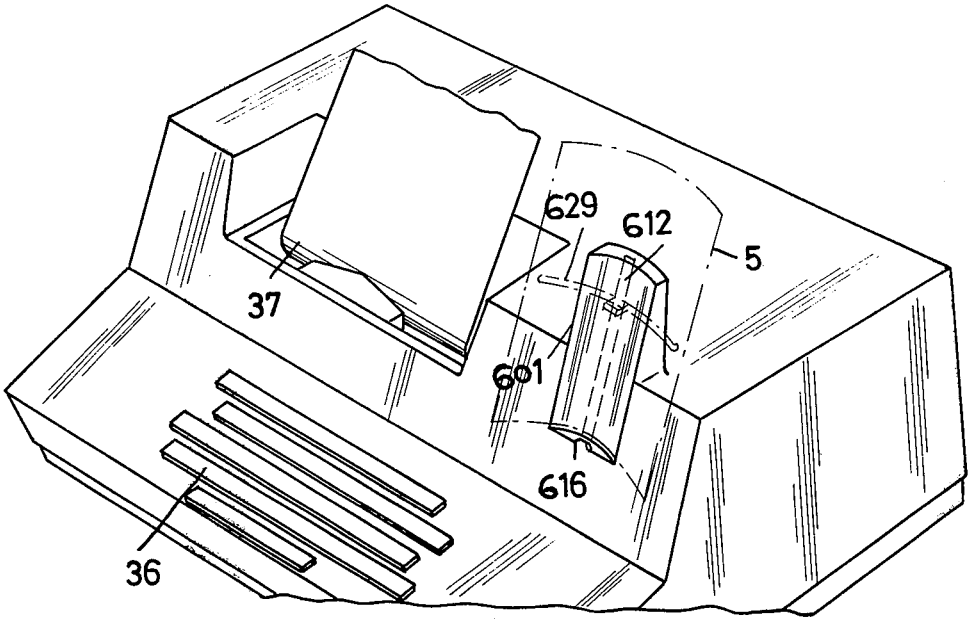
Figure 15:
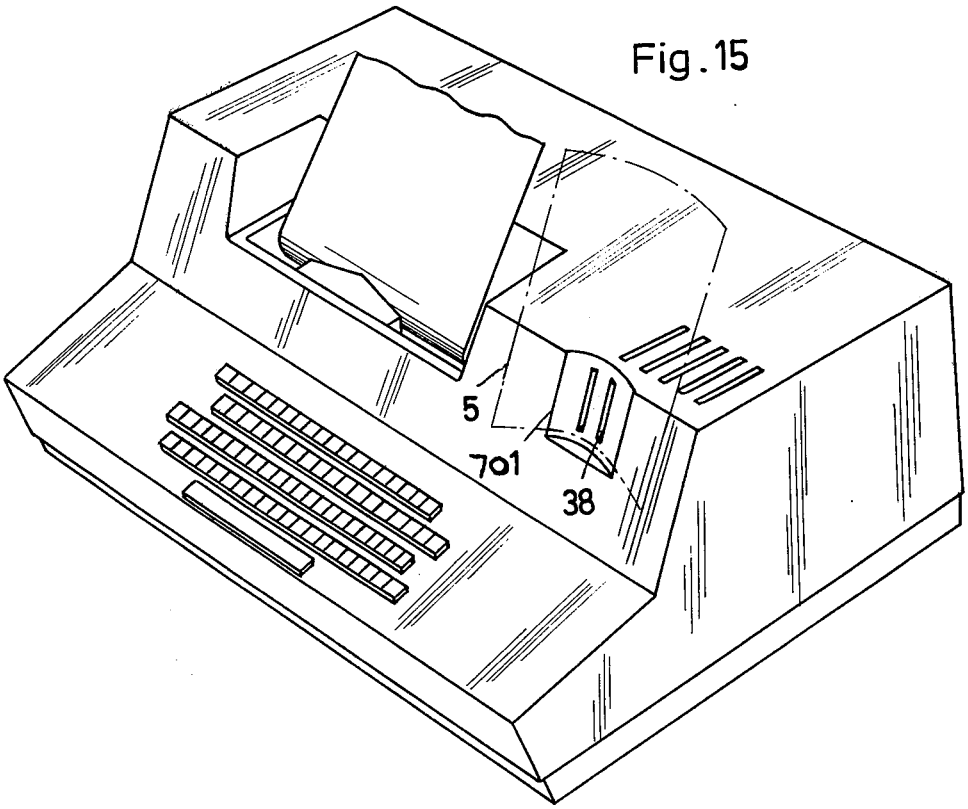
Figure 16:
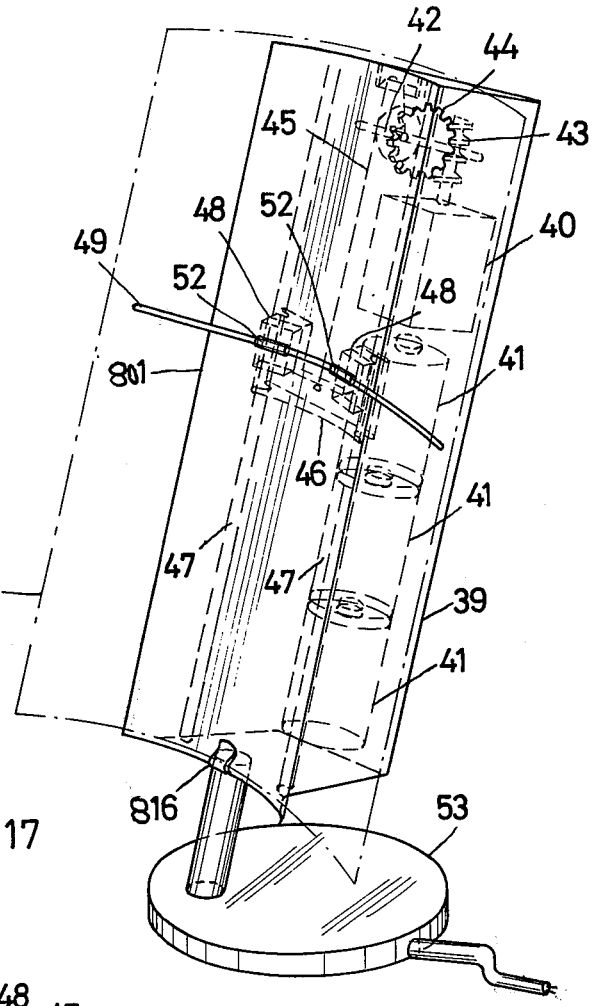
Figure 17:
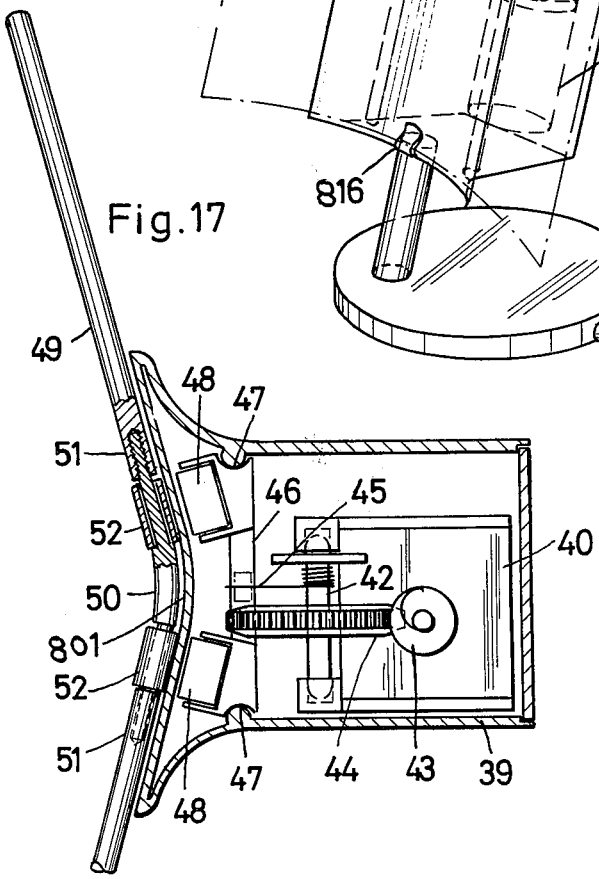

FIGS. 5, and 6 show a further embodiment which is pivotable and may be used in two positions;

FIG. 7 is a cross-sectional view of FIG. 8 taken along line A—A;

FIG. 8 is a front view of the angled body of the further embodiment of FIGS. 5 and 6, FIG. 9 shows a retaining means for the inventive device using a suction head;

FIG. 9*a* shows a retaining means for the inventive device using a permanent magnet;

FIG. 10 shows a further embodiment of the device which may be freely supported on a table, a machine, or which may be supported by a screw;

FIG. 11 shows a similar embodiment as shown in FIG. 10;

FIG. 12 shows an embodiment similar to the one of FIG. 10 which is pivotable and is height adjustable by a sliding part;

FIG. 13 shows one embodiment of the device which is combined with a container for receiving further operating materials;

FIG. 14 and 15 shows housing of teletypes or electrical typewriters with integrated means in accordance with the invention;

FIGS. 16 shows a further embodiment of the device wherein by means of an installed motor, an indicator may be remotely controlled; and FIG. 17 is a partial cross-sectional view of the device of FIG. 16.

Figure 1:
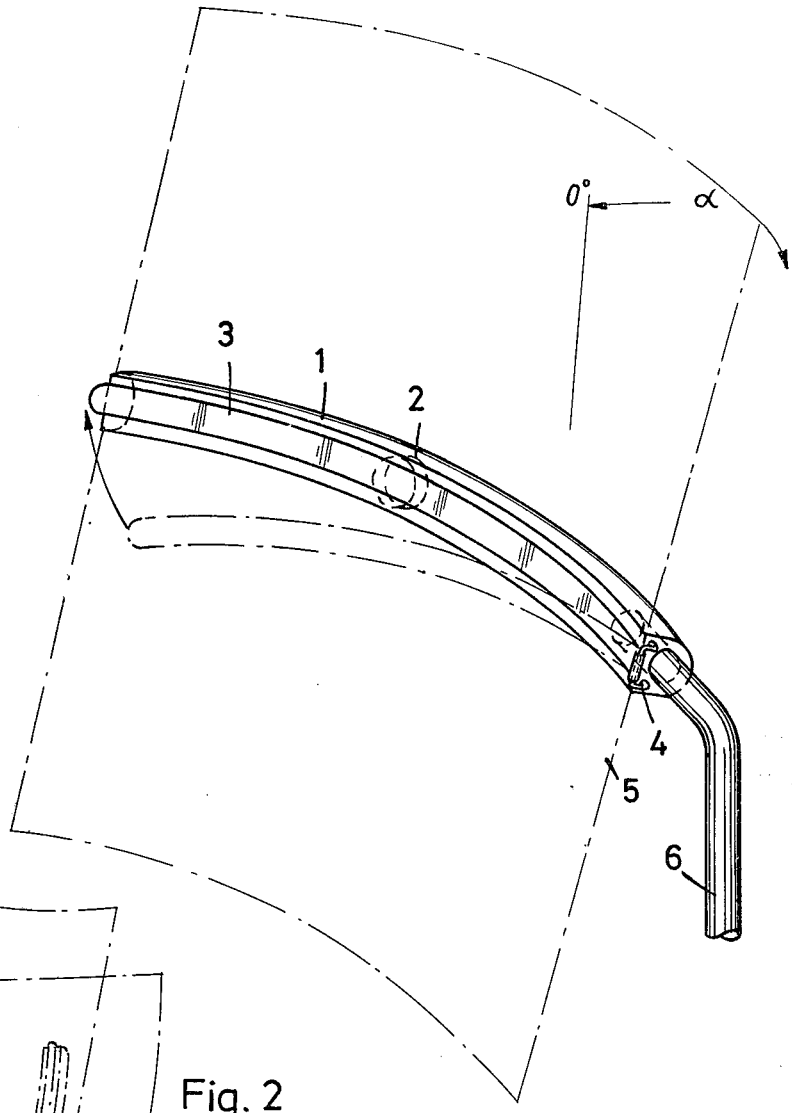
FIG. 1 shows a preferred embodiment of the device in accordance with the invention which is pivotably held on a rod in the correct position.

FIG. 1 shows one embodiment of the invention consisting of a curved or angled strip or angled surface 1 made preferably of a magnetic material, such as a ferromagnetic sheet metal. In the embodiment shown in FIG. 1, the angled strip of material can also be made of a plastic material, with a built in magnet 2. A yieldable strip 3 made of a magnetizable material is connected at one end with the angled strip, such as by bending over a pin 4, wherein the pin serves as an abutment for the information carrier 5 shown in broken line, which could be an inscribed or lettered page of paper.

Angled strip 1 is mounted at one end on a support such as a rod 6, which may be in contact with a corresponding table, wall, or machine. As can be seen by angle $\alpha$, angled surface 1 can be pivoted at any given position, so that the angle at 0° is perpendicular with respect to the machine or the working table. Information carrier 5 is inserted between angled strip 1 and the pulled back yieldable strip 3. When yieldable strip 3 is brought into engagement with the angled strip, a pressure is created by the magnetic forces of magnet 2 which pushes the information carrier against the angled strip. Due to the created angle for the unstable information carrier, the carrier is stiffened to a point where it is possible to fix it so that it can be readily read at any given position or angle, without using any further aids. The stiffened information carrier can be pulled by hand either upwardly or downwardly. The yieldable strip, which is held by magnet 2, remains at the same spot, and may be used as a line indicator.

Figure 2:
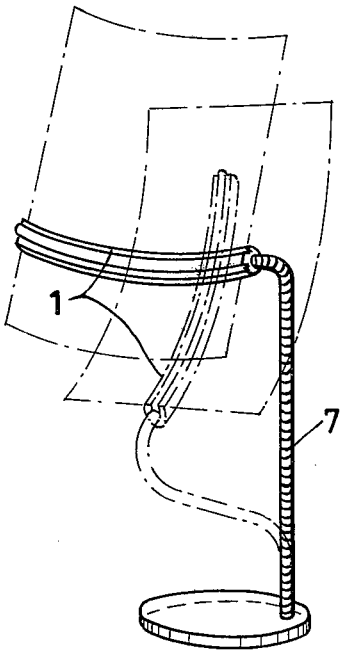
FIG. 2 shows the embodiment of FIG. 1 pivotably mounted on a flexible arm for use both horizontally as well as vertically.

As can be seen from FIG. 2, a flexible arm 7 is provided on which angled surface 1 is supported. Surface 1 can thus be pivoted from a horizontal position into a vertical position. Simultaneously the angled surface can be pivoted around the axis of arm 7.

Figures 3, 4:
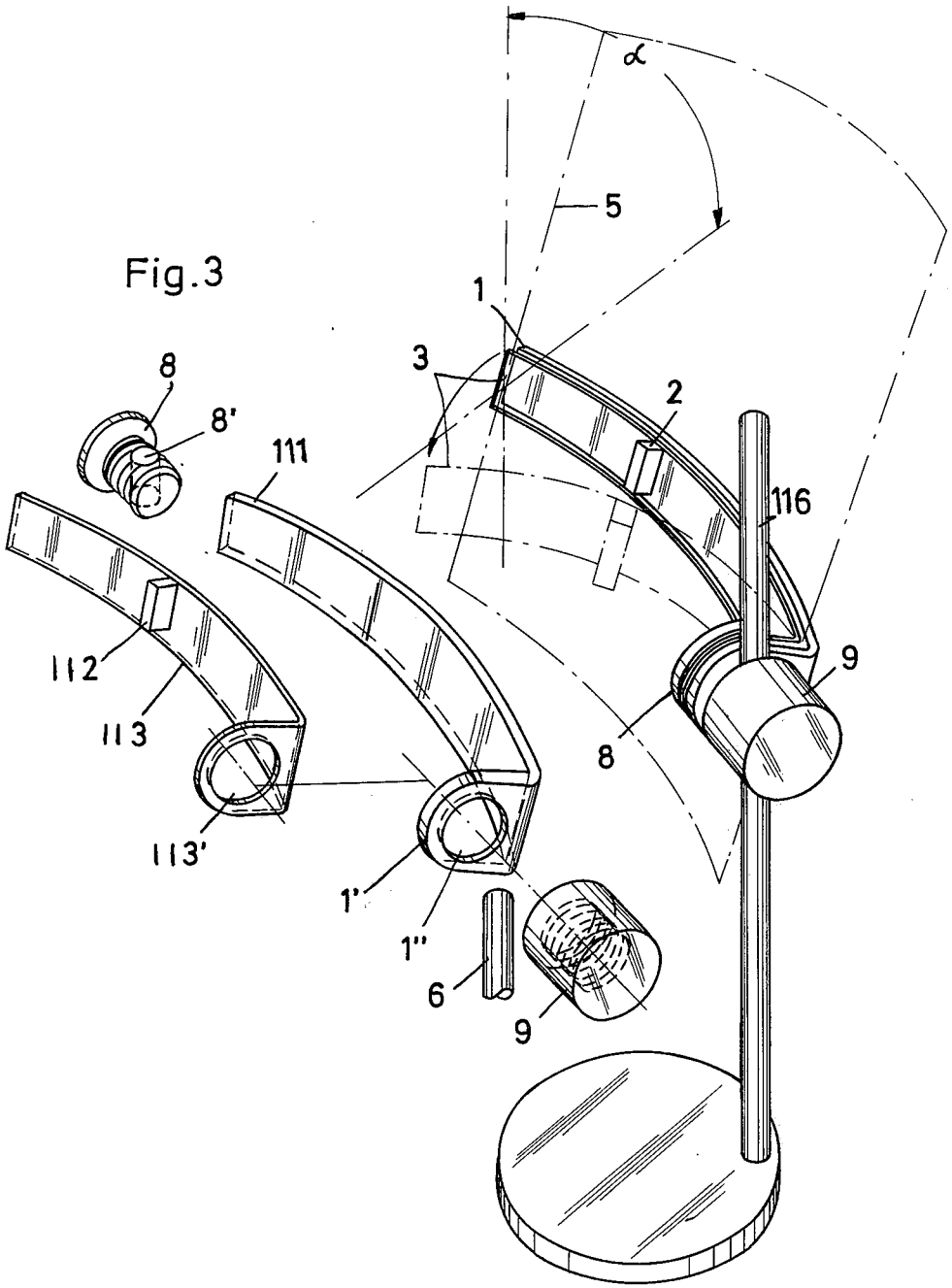
FIG. 3 shows a further embodiment of the device in individual parts and in an exploded view.
FIG. 4 is a perspective view of the embodiment of FIG. 3 in an assembled position.

FIG. 3 shows a further embodiment of the device in an exploded view. Angled surface 111, which preferably may be of a ferromagnetic material, is provided with a bent end 1' which has an aperture 1''. Yieldable strip 113, which preferably consists of a transparent material, also has a corresponding end bent, and the end is provided with an aperture 113'. A magnet 112 is mounted on the yieldable strip. Parts 111 and 113 are connected by a screw 8, bore 8' and a bolt 9, and are maintained at a given height on a rod 116 which is mounted on bore 8' of screw 8. FIG. 4 shows the parts described in conjunction with FIG. 3 in an assembled position.

Information carrier 5 shown in dotted lines is inserted between parts 112 and 113, and is pressed by magnet 112 which is mounted on part 113, against angled strip 111. By this process, the unstable and soft information carrier is angled and is thereby provided with a self supporting stiffness.

As shown by angle $\alpha$, the angled surface can be pivoted at will, if a bolt 9 is not completely screwed down on screw 8. Simultaneously, the angled surface may be adjusted at any given direction with respect to the retaining rod 116. After a given adjustment of the height and the angle of the information carrier held in the device, the information carrier may be fixed into a position for reading by fixing the bolt against the rod.

The stiffened information carrier can be adjusted upwardly or downwardly whereby strip 113 may be used as an indicator. Furthermore, strip 113 may be provided with markings which may be used for indexing the material to be copied.

In a further embodiment shown in FIGS. 5, 6, 7 and 8, the angled surface consists of a prismatic or pyramidelike body 10 which is provided at one side with a longitudinally running angle 11 with a built in in magnetic material 12, and at the other side, with a laterally running angle 13. At the end a shoulder with a groove 14 is provided. The prismatic body is provided with a device 15, such as an embossed thread jacket for receiving different types of mounting means.

Body 10 is so shaped at its open end, that it can be placed onto a working table or on a machine without any further attachments. In this case, the longitudinally running angle 11 is used for information carrier 5. At the lower end, a clamp 16 is provided into which the information carrier is inserted. The unstable information carrier is pressed by retaining clamp 16 against the angled surface and stiffened by the angle.

FIG. 5 shows the embodiment of the invention which is adjustable in all possible directions by device 15, and is horizontally adjustable by retaining means 17, so that the laterally running angle is in front. In this embodiment, information carrier 5, shown in dotted lines, is pressed against the laterally running angle by a preferably transparent material, which is held in place by a groove 14 at both ends thereof. The yieldable strip which presses against the angle in the operating position, may be pulled back by means of a gripper 19 for inserting the information carrier (see FIG. 7), so that yieldable strip 18 comes to a rest position with an angle which runs countercurrent to the lateral angle. When the information carrier is inserted and pressed against the laterally running angle by the yieldable strip, the information carrier is stiffened and may be pulled either upwardly or downwardly, so that the yieldable strip may be used as an indicator, as described in conjunction with FIG. 4. By loosening a knurled wheel 20 of adjustable retaining means 17, the angled surface may be adjusted accordingly. By loosening a knurled wheel 21, the angled surface on retaining rod 6 may be moved upwardly or downwardly.

FIG. 6 shows the embodiment of the invention wherein the longitudinal angle is in front. By loosening knurled wheel 20 in retaining means 17, the angled surface is brought from a vertical position up to a rearwardly inclined position of about 75° by angle $\alpha$. Information carrier 5 is pressed against the angled surface by retaining clamps 16 as previously described.

A runner 22, provided with a permanent magnet 23 at its center portion, cooperates with ferromagnetic strip 12 through information carrier 5. Runner 22 is retained on strip 12, and is moveably mounted on the information carrier, and serves as an indicator.

In FIGS. 7 and 8, yieldable strip 18, which is used with the lateral angle, and which is provided with a permanent magnet in its gripper 19, is used as a runner.

FIG. 9 shows an embodiment of the invention wherein body 10 is connected with a suction head 25 by means of a ball and socket joint 24. The angled surface thus may be mounted at any given inclined or straight surface of a machine. A further mounting possibility is shown in FIG. 9*a*, wherein a permanent magnet 26 is mounted at the lower side of body 10, so as to provide a supporting means on a ferromagnetic part of a device or a table.

As can be seen from FIG. 10, one of the embodiments consists essentially of an angled strip or surface 201 made preferably of a magnetic material, such as ferromagnetic sheet metal. The lower side of the angled sheet metal strip is bent to form a shoulder 27. At bolt 28, a supporting means is provided, such as a stop pin for mounting on a machine or on an operating table. The mounting should be done in such a way that the angled surface 201 can be pivoted around the axis of bolt 28. A clamping pin 216 is provided at the lower side of angled surface 201 into which the information carrier, shown in dotted lines, for example, an inscribed, or printed page of paper may be inserted.

When angled surface 201 consists of a ferromagnetic sheet metal, a runner 222 may be mounted on the information carrier. Runner 222 has a permanent magnet 223 at its center, and cooperates with angled surface 201 through information carrier 5, and thus is held in position. Runner 222 may consist of a yieldable plastic material. It is possible to displace the runner longitudinally along the angled surface 201.

In the embodiment shows in FIG. 11, angled surface 301 consists of a non-magnetizeable material having a longitudinal groove 30 in its center. A permanent magnetic material 312 is provided in groove 30, such as a strip-like magnetized plastic bound permanent magnet. Runner 29 may consist of a correspondingly angled ferromagnetic strip of sheet metal. However, the runner may also consist of a plastic material which has a strip of a ferromagnetic strip of sheet metal 31 in the range of the permanent magnet 312 which cooperates with the permanent magnet, and presses the runner against angled surface 301. Information carrier 5 also assumes a corresponding angle, and thus is held in a self supporting position in the correct reading position. The rearwardly angled lower side of angled surface 301 may be provided with a suction head, a supporting magnet or a mounting screw for mounting on a machine or a working table, as can be seen in FIGS. 9 and 9*a*. On the other hand, the angled surface may be used free from any additional mounting means.

FIG. 12 shows a different embodiment of FIG. 10. Angled surface 401 is in the form of a hollow body on which a further angled surface 32 may be inserted, and which is displaceable in upward and downward movement. In this manner, it is possible to extend the angled surface for a larger information carrier, since the second angled surface 32 can be moved upwardly and downwardly. A retaining clamp 416 is mounted at the upper portion of the second slideable angled surface 32, and is a gripper for both inserting and extending angled surface 32. Furthermore, this embodiment is provided with a wire yoke 33 which supports the device, and retains it at a desired angle $\alpha$.

FIG. 13 shows a further embodiment of the device wherein the angled surface 501 is connected in a unitary unit at the end of a cylinder-like container 34. Information carrier 5 shown in dotted lines, is pressed against the angled surface by means of a clamp, or by means of a magnet as described above. Working utensils 35, for example, pencils, felt markers, erasors, scissors, etc. may be placed into container 34.

FIG. 14 shows the housing of a teletype machine or a typewriter with an associated keyboard 36 and an information carrier 37. The angled surface is integrated into the housing of the machine. A clamp 616 is also an integral part of the machine housing. A strip magnet 612 is also an integral part of angled surface 1, and is retained by integral retaining means. Instead of a strip magnet, a plurality of permanent magnets may be substituted in series, or a ferromagnetic strip may be provided. When a permanent magnet is used at the inner side of the angled surface 601, a runner 629 made of a correspondingly angled ferromagnetic or plastic material may be employed, using a ferromagnetic gripper which cooperates through information carrier 5 with the permanent magnet. When ferromagnetic strip is used at the inside of angled surface 601, a runner with a permanent magnet as shown in FIG. 10 may be used.

FIG. 15 shows a further embodiment in accordance with the invention, wherein the angled surface 701 is an integral part of the machine housing. The mounting of information carrier 5 for reading is done by openings 38 in angled surface 701, through which air is sucked by means of a blower motor. Information carrier 5 is thus sucked onto angled surface 701, and shaped accordingly, thus providing a stiffening effect, so that the information carrier is self-supporting at the machine housing.

As can bee seen from FIGS. 16 and 17, this embodiment of the invention essentially consists of a hollow body 39 having an angled surface 801 at one side, and having a retaining clamp 816 at its lower side into which an information carrier 5 is inserted. An electric motor 40 is provided at the inside of hollow body 39. The motor may be driven by batteries 41, or plugged into an electrical outlet. The motor drives a gear 42, by means of a worm gear 43 and spur gear 44. Driven gear 42 is connected to a thread 45, which is connected with one end with a carrier 46. The carrier is guided by longitudinally running shoulders 47 inside hollow body 39. Two permanent magnets 48 are mounted on the carrier. By actuating a double switch, preferably a foot switch (not shown), which is connected in known manner with the drive unit, the carrier may be moved upwardly and downwardly, as desired. A runner 49 consists of an angled rod 50 at which an extension piece 51 is mounted at each end, for example, by slipping or screwing the extension rod onto angled rod 50.

The assembled rod has a reduced diameter at two places which are located opposite permanent magnet 48. At these locations, two jackets 52 made of ferromagnetic material are mounted. Permanent magnets 48, which are mounted on carrier 46, act on jackets 52 which run through the angled surface 801 and information carrier 5, if and when carrier 46 is moved upwardly or downwardly. In this way, runner 49 may be remotely controlled and used as a line indicator for copying work. The device is mounted on a support 53.

While only a few embodiments of the present invention have been shown and described, it will be obvious to those skilled in the art that many changes and modifications may be made thereunto without departing from the spirit and scope of the invention.

What is claimed is:

1. A device for holding flexible, yieldable information carriers such as paper in a correct readable position, comprising:

securing means for clamping the flexible, yieldable information carrier to at least partially stiffen the same, so that it remains in a freely supported reading position, said securing means comprising a member including first and second connected surfaces, said first surface including a longitudinally running curve and a magnetic strip built-in to said first surface, said second surface being connected with said first surface with a laterally running curve, a runner including magnetizable means associated with and cooperating with said magnetic strip, a retaining clamp associated with the bottom of said first surface and cooperating with said runner whereby to retain an unstable information carrier pressed against said first surface, a groove holding element formed on one pair of two opposite sides of said second surface for holding an information carrier thereagainst, a flexible yieldable strip having its ends held by said groove holding element on each of said two opposite sides, said yieldable strip being wider than the distance between said two opposite sides and adjusted to press against said second surface and held thereto by said groove holding elements, and gripper means associated with said yieldable strip for separating said strip from said second surface whereby to permit insertion of an information carrier onto said second surface, said member being adapted to have an information carrier placed onto either said first or said second surfaces whereby to permit said member to be used in different positions thereof.

2. The device according to claim 1, including means for operatively connecting said securing means to an object.

3. The device according to claim 2, wherein said connecting means includes vertical adjustment means and horizontal adjustment means to permit all angular positions of said securing means relative to said object.

* * * * *